US007644927B2

(12) United States Patent
Law

(10) Patent No.: US 7,644,927 B2
(45) **Date of Patent: *Jan. 12, 2010**

(54) TARGET SUPPORT SYSTEM

(75) Inventor: Verl Law, Emmett, ID (US)

(73) Assignee: Verl J. Law, Emmett, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/098,040

(22) Filed: Apr. 1, 2005

(65) Prior Publication Data

US 2006/0220318 A1 Oct. 5, 2006

(51) Int. Cl.
*F41J 1/10* (2006.01)
*G09F 15/00* (2006.01)

(52) U.S. Cl. ..... 273/407; 273/380; 248/215; 248/340; 40/607.06; 40/607.09; 40/607.1; 40/611.07

(58) Field of Classification Search ..... 248/215, 248/315, 339–341, 307; 273/390–392, 406, 273/407, 403, 404, 408
See application file for complete search history.

(56) References Cited

U.S. PATENT DOCUMENTS

| | | | | |
|---|---|---|---|---|
| 216,177 | A | 6/1879 | Greig | |
| 1,002,260 | A | 9/1911 | Golden | |
| 1,098,255 | A | 5/1914 | Harper | |
| 1,506,668 | A | 8/1924 | Rose et al. | |
| 2,246,229 | A * | 6/1941 | Wohlmuth | 452/187 |
| 2,372,111 | A | 3/1945 | Norberg | 273/102 |
| 2,722,420 | A | 11/1955 | Adamson | 273/102 |
| 2,890,051 | A | 6/1959 | Williams | 273/102 |
| 3,080,166 | A | 3/1963 | Clark | 273/102 |
| 3,169,771 | A | 2/1965 | Holmes | 273/186 |
| 3,240,463 | A * | 3/1966 | Cook | 248/339 |
| 3,411,784 | A | 11/1968 | Lawrence | 273/102 |
| 3,540,729 | A | 11/1970 | Rahberger | 273/102 |
| 3,601,353 | A | 8/1971 | Dale | 248/470 |
| 3,647,214 | A | 3/1972 | Hohmann | 273/105.6 |
| 3,752,476 | A | 8/1973 | Mahoney | 273/1.5 A |
| 3,774,911 | A | 11/1973 | Benfield | 273/95 R |
| 4,029,318 | A | 6/1977 | Boss | 273/102 S |
| 4,343,449 | A | 8/1982 | Osthus | 248/156 |
| 4,491,327 | A | 1/1985 | Morris | 273/343 |
| 4,588,194 | A | 5/1986 | Steidle et al. | 273/391 |
| 4,726,593 | A | 2/1988 | Wade | 273/392 |
| 4,750,697 | A * | 6/1988 | Tontarelli | 248/215 |
| 4,811,956 | A | 3/1989 | Foreman | 273/407 |
| 4,913,389 | A | 4/1990 | McCracken | 248/156 |
| 5,020,755 | A * | 6/1991 | Frankel | 248/215 |
| 5,036,613 | A | 8/1991 | Smith | 42/94 |
| 5,067,683 | A | 11/1991 | Wager | 248/545 |

(Continued)

*Primary Examiner*—Mark S Graham
(74) *Attorney, Agent, or Firm*—Kent S. Burningham

(57) ABSTRACT

A modular set of elements are nondestructively assemblable into and disassemblable out of a plurality of configurations of a system for supporting targets and signs on a hard surface or on soft ground. These elements include an upright, a base that upholds the upright and is disposable in a stable manner on a hard surface or on soft ground, a horizontal arm from which to suspend a target or sign, and a brace slidable on the outer surface of the upright that includes a tubular shoulder capable of receiving an end of the horizontal arm. A hanger of unitary molded construction is capable of suspending from a horizontal support a clay target of the type cast by trap or skeet shooting equipment.

58 Claims, 11 Drawing Sheets

U.S. PATENT DOCUMENTS

| | | | | | |
|---|---|---|---|---|---|
| 5,165,694 | A | | 11/1992 | Kraushaar | 273/343 |
| 5,209,492 | A | | 5/1993 | Hamilton | 273/407 |
| 5,224,607 | A | * | 7/1993 | Koresko | 211/34 |
| 5,441,267 | A | | 8/1995 | Alder | 273/177 R |
| 5,492,297 | A | * | 2/1996 | Underwood | 248/340 |
| D375,673 | S | | 11/1996 | Schowalter | D8/367 |
| 5,580,062 | A | * | 12/1996 | Dehlinger | 273/378 |
| 5,671,924 | A | | 9/1997 | Scott | 273/407 |
| 5,678,824 | A | | 10/1997 | Fortier et al. | 273/407 |
| 5,860,534 | A | | 1/1999 | Minneman et al. | 211/13.1 |
| 5,860,654 | A | | 1/1999 | Jacobs | 273/407 |
| D405,834 | S | | 2/1999 | Weng et al. | D21/5 |
| 5,938,203 | A | | 8/1999 | Beckwith, Sr. | 273/407 |
| 5,947,477 | A | | 9/1999 | Turnipseed | 273/407 |
| 5,967,523 | A | | 10/1999 | Brownlee | 273/407 |
| 6,041,559 | A | | 3/2000 | Schickert et al. | 52/165 |
| D423,057 | S | | 4/2000 | Mooney | D21/304 |
| D425,135 | S | | 5/2000 | Quiring | D21/302 |
| 6,196,511 | B1 | | 3/2001 | Beauchemin | 248/328 |
| 6,257,584 | B1 | | 7/2001 | Nasuti | 273/407 |
| D447,656 | S | | 9/2001 | Richter | D6/513 |
| 6,435,512 | B1 | | 8/2002 | Beckwith, Sr. | 273/407 |
| D478,939 | S | | 8/2003 | McReynolds | D21/302 |
| 6,666,781 | B1 | | 12/2003 | Illis | 473/453 |
| 6,726,208 | B2 | | 4/2004 | Wilkus | 273/407 |
| 6,761,357 | B2 | * | 7/2004 | Witt et al. | 273/407 |
| 7,000,783 | B2 | * | 2/2006 | Webb | 211/20 |
| D523,907 | S | * | 6/2006 | Law | D21/302 |
| D524,379 | S | * | 7/2006 | Law | D21/302 |
| 2002/0088157 | A1 | | 7/2002 | Winterton et al. | 40/610 |

* cited by examiner

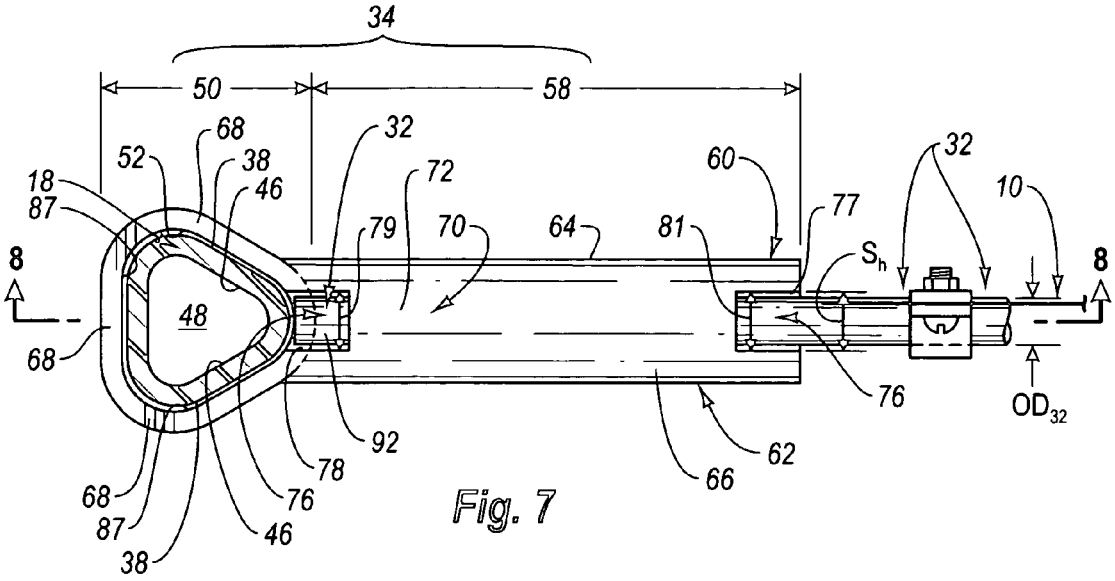
Fig. 7
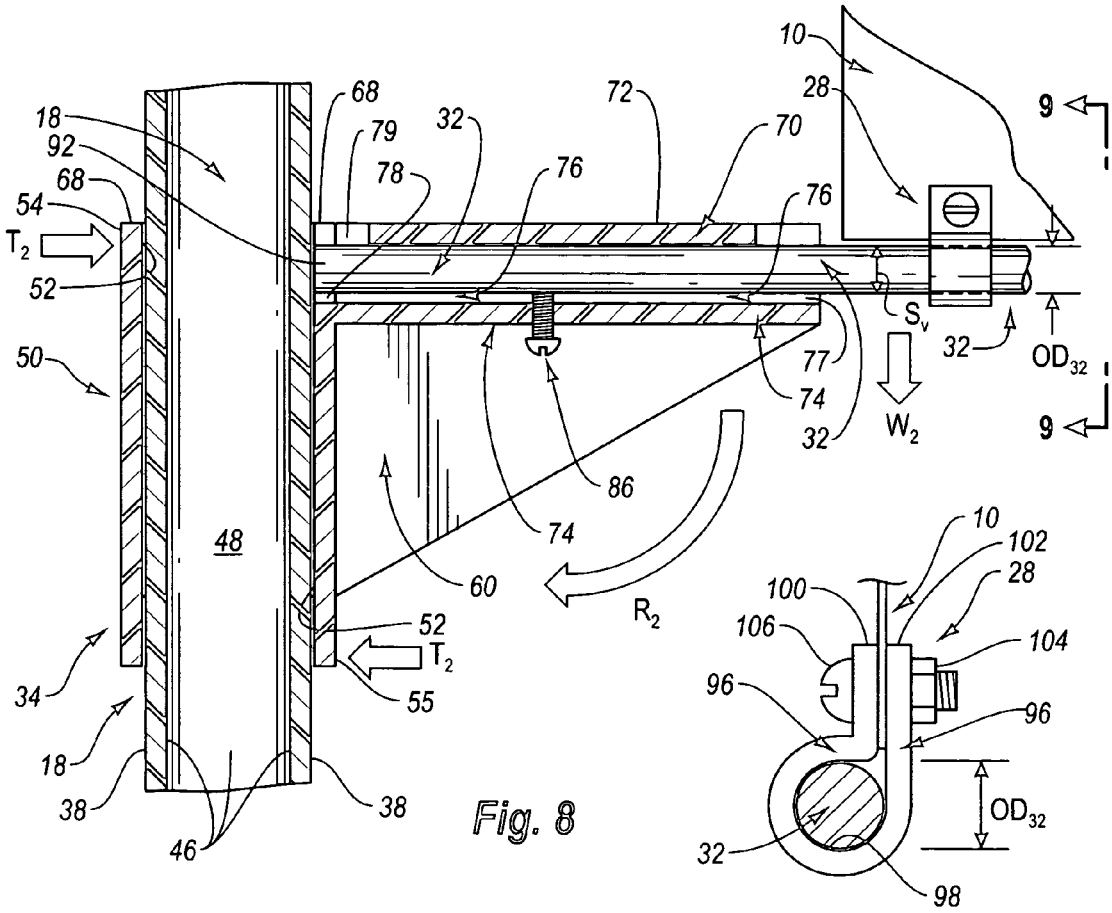
Fig. 8
Fig. 9

TARGET SUPPORT SYSTEM

CROSS-REFERENCE TO RELATED APPLICATIONS

This application is related to U.S. Design patent application Ser. No. 29/226,833 for "Target Hanger" and U.S. Design patent application Ser. No. 29/226,884 for "Base for a Target and Sign Support" that were filed contemporaneously herewith on Apr. 4, 2005.

BACKGROUND

Field of the Invention

This invention pertains to systems for supporting targets and signs. More particularly, the invention pertains to such systems as to include a plurality of modular components that are capable of assembly in various configurations and also capable of subsequent nondestructive disassembly for compact transport and storage.

BRIEF DESCRIPTION OF THE DRAWINGS

The manner in which the advantages and objects of the invention are obtained will be understood by a description of the invention rendered by reference to specific embodiments thereof that are illustrated in the appended drawings. Understanding that these drawings depict only typical embodiments of the invention and are not therefore to be considered limiting of the scope thereof, the invention will be described and explained with additional specificity and detail through the use of the accompanying drawings in which:

FIG. 7 is a top view in partial cross section of the portion of the target and sign support system of FIG. 1 at which there is a mechanical interaction among the upright element, the lower horizontal support arm element, and the lower brace element of that system;

FIG. 8 is an elevation cross section view of FIG. 7 taken along section line 8-8 shown therein;

FIG. 9 is a side view of the clamp element illustrated in FIGS. 7 and 8 from the target and sign support system of FIG. 1;

DETAILED DESCRIPTION OF THE INVENTION

The disclosed target and sign support system is a modular set of components that are capable of versatile assembly in a plurality of configurations for the purpose of supporting signs or various targets for firearm or bow practice on soft ground or on a hard flat surface. The components of the system are selectively and nondestructively disassemblable for subsequent reuse. These components, which are throughout this disclosure interchangeably referred to also as elements of the disclosed system, are sufficiently impervious to degradation by outdoor elements, such as sun, wind, temperature, and precipitation, as to be capable of remaining outdoors in assembled or disassembled condition for extended periods without loss of functionality. Targets and signs used with the system may or may not be similarly weather resistant.

Figure 1:
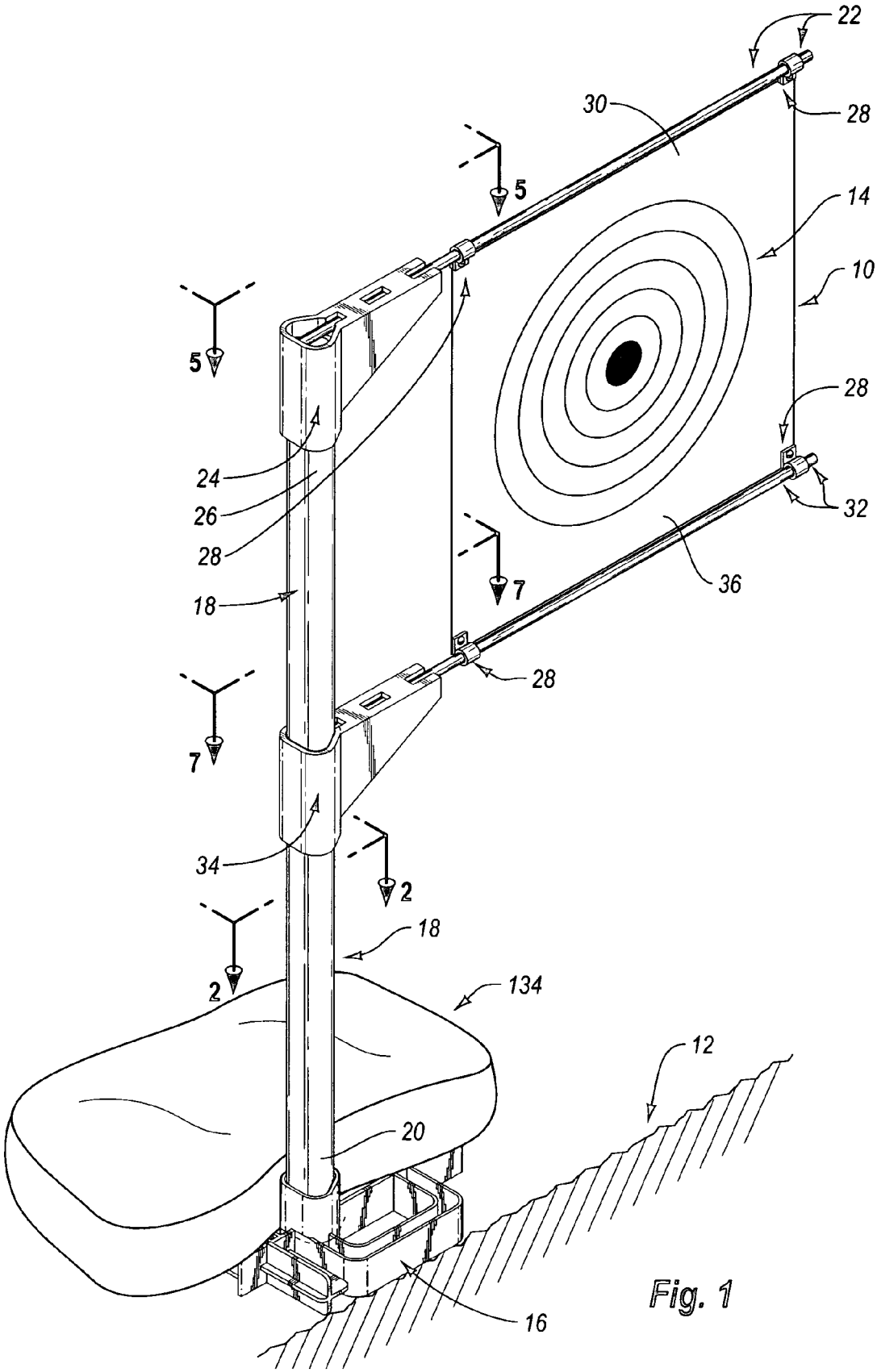
FIG. 1 is a perspective view of a first embodiment of elements of a target and sign support system incorporating teachings of the present invention assembled on a hard surface to uphold a sheet of material bearing targeting indicia.

FIG. 1 depicts elements of a first embodiment of a target and sign support system assembled on a hard surface 12 to display indicia carried on a sheet 10. Sheet 10 is any type of thin, flexible or rigid, solid, perforated, or diaphanous material capable of being imprinted with designs and lettering for visual apprehension. As the indicia presented on sheet 10 in FIG. 1 is a marksman target 14, it is probable that sheet 10 is comprised of paper or cardstock, rather than fabric or sheet metal, which might preferably be employed were sheet 10 intended to bear signage of a permanent or repeatedly-reusable nature. Paper or cardstock could, however, serve suitably to display signage under many circumstances.

The elements of the target and sign support system of FIG. 1 include a base 16 that contacts hard surface 12, an upright 18 upheld from the lower end 20 thereof by base 16, a horizontal upper arm 22 above sheet 10, and an upper brace 24 by which upper arm 22 is upheld at the upper end 26 of upright 18 in a cantilever fashion. A plurality of clamps 28 engage both upper arm 22 and the upper edge 30 of sheet 10, thereby to suspend sheet 10 downwardly from upper arm 22 adjacent to upright 18. Also included in the target and sign support system of FIG. 1 are a horizontal lower arm 32 disposed below sheet 10 and a lower brace 34 by which lower arm 32 is secured to upright 18 intermediate upper end 26 and lower end 20 thereof. An additional plurality of clamps 28 interconnects lower arm 32 and the lower edge 36 of sheet 10.

The use of lower arm 32 is optional in the target and sign support system of FIG. 1. Lower arm 32 and clamps 28 associated therewith may afford support for sheet 10, as might, for example, be desirable were sheet 10 a rigid, solid, or perforated structure of substantial weight. In general, however, lower arm 32 and clamps 28 associated therewith function to maintain sheet 10 in a stable, flattened configuration by fixing lower edge 36 of sheet 10 vertically below and in a taut relation to upper edge 30 thereof, preventing upward curling of lower edge 36 of sheet 10 or any forward and backward movement of sheet 10 caused by breezes or by projectiles directed at sheet 10 during marksmanship practice. Forward and backward movement of sheet 10 might otherwise take the form of a flapping dislodgement from the vertical orientation illustrated in FIG. 1 or, were sheet 10 to be composed of a rigid material, a planar pivoting of sheet 10 about upper arm 22.

Figure 2:
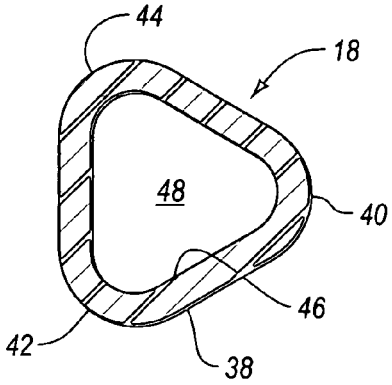
FIG. 2 is a transverse cross section view of the upright element of the target and sign support system of FIG. 1 taken along section line 2-2 shown therein.

FIG. 2 is a transverse cross section view of upright 18 of FIG. 1 taken along section line 2-2 therein. Upright 18 is there revealed to be a tubular structure having an outer surface 38 that exhibits a generally triangular and equilateral cross-sectional configuration with rounded vertices 40, 42, 44. A similar but smaller generally triangular inner surface 46 defines a passageway 48 that extends longitudinally through the full extent of upright 18 from upper end 26 to lower ends 20. This results in a rigid, self-sustaining structure in upright 18 of relatively light weight construction having outer walls of substantially uniform thickness.

Nonetheless, the cross section of inner surface 46 of upright 18 need not as illustrated in FIG. 2 be similar in shape to that of outer surface 38, and upright 18 need not have outer walls of substantially uniform thickness. Typically, upright 18 can be extruded from plastic or metal materials. Nonetheless, the manufacture of upright 18 can be undertaken by other known methods and using a variety of composite materials. Although upright 18 is a hollow structure, circumstances exist in which the upright in the target and sign support system of FIG. 1 may advantageously be configured as a solid structure of uniform or layered material composition.

While structural and functional advantages arise from an outer cross-sectional configuration in upright 18 that is generally triangular, alternative outer cross-sectional configurations are also appropriate. Thus, the outer cross-sectional configuration of upright 18 could assume the shape of a regular or an irregular polygon with or without vertices that are rounded. The outer cross-sectional configuration of upright 18 could in whole or in part be a symmetric or an asymmetric curve, and outer surface 38 of upright 18 could include concavities, as would exist in a crescentic outer cross-sectional shape, or struts, as would exist in an outer cross-sectional shape like a star or a cross.

All such configurations in upright 18 would inherently include features on the exteriors thereof that would permit upright 18 to be keyed in a nonrotatable relative relationship with other elements of the target and sign support system of FIG. 1. Where such a relationship among the elements of that target and sign support system is not desired, however, upright 18 can be configured with a circular outer cross-sectional shape, in which instance, other elements of the target and sign support system would be selectively or freely rotatable relative to upright 18 about the longitudinal axis thereof.

The implications of the exterior cross-sectional configuration of upright 18 for other elements of the target and sign support system of FIG. 1 will be more readily apparent following a discussion of the configuration recommended in upper brace 24 and in lower brace 34 for use with an upright having an outer cross-sectional configuration like that shown in FIG. 2 for upright 18. Upper brace 24 and lower brace 34 may be manufactured using an injection molding process from plastic, metal, or composite materials.

Upper brace 24 and lower brace 34 are identical structures that interact mechanically with other elements of the target and sign support system of FIG. 1 in such distinct manners as to be, either freely slidable along outer surface 38 of upright 18, or fixed from downward movement at upper end 26 of upright 18. Therefore, a detailed investigation of the common structures in upper brace 24 and lower brace 34 will first be provided by reference, by way of example, to the perspective view of upper brace 24 provided in FIG. 3 and the companion elevation cross section view of upper brace 24 provided in FIG. 4.

Figure 3:
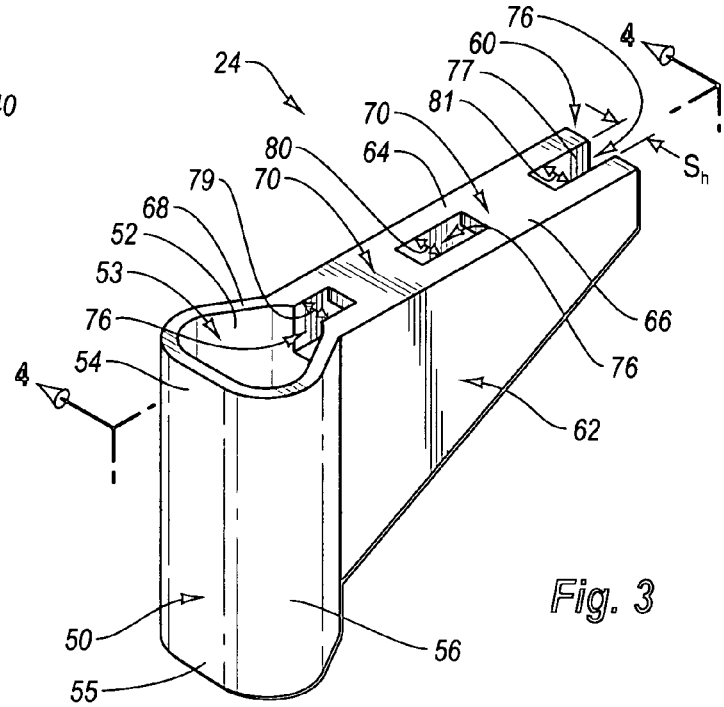
FIG. 3 is an enlarged perspective view of a brace element of the target and sign support system of FIG. 1.
Figure 4:
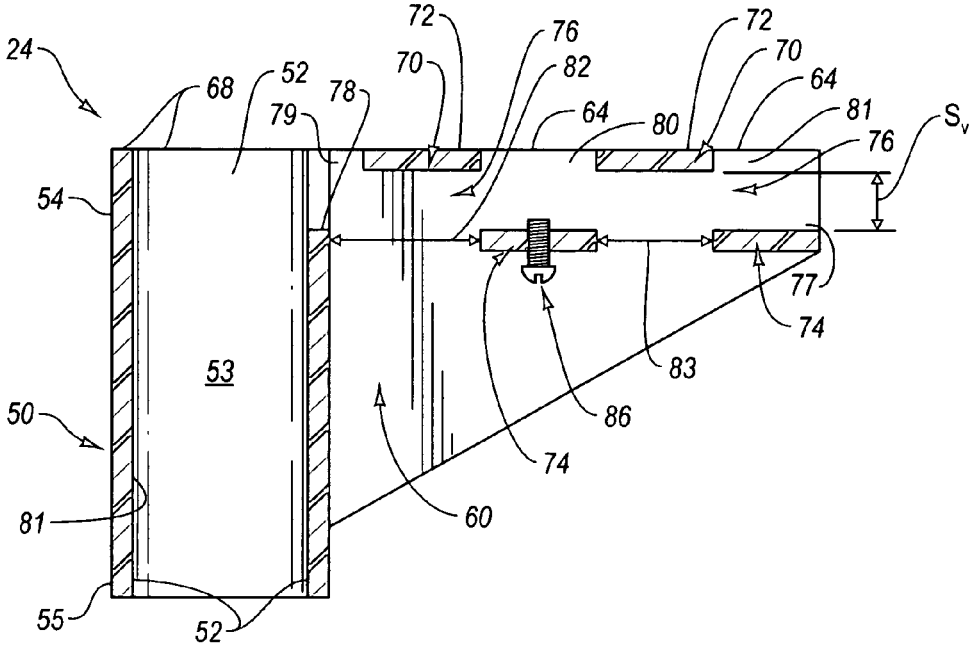
FIG. 4 is an elevation cross section view of the brace element of FIG. 3 taken along section line 4-4 shown therein.

As seen in FIG. 3, upper brace 24 includes a sleeve 50 having an inner surface 52 that exhibits a generally triangular and equilateral cross-sectional configuration and that defines a longitudinally extending, open-ended passageway 53 that extends through sleeve 50 from upper end 54 to lower end 55 thereof. Sleeve 50 has a similar but larger generally triangular outer surface 56 so positioned relative to inner surface 52 as to produce outer walls in sleeve 50 of substantially uniform thickness. Inner surface 52 of sleeve 50 is proportioned to slidably encircle outer surface 38 of upright 18 as illustrated in FIG. 2. Nevertheless, the cross section of outer surface 56 need not, as illustrated in FIG. 3, be similar in shape to that of inner surface 52, and sleeve 50 need not have outer walls of substantially uniform thickness.

Upper brace 24 also includes a tubular shoulder 58 that projects from the exterior of sleeve 50 in a generally perpendicular relationship to the longitudinal axis of sleeve 50. Shoulder 58 includes identical, generally right triangular, parallel-disposed stay plates 60, 62, that are separated by a horizontal distance $S_h$. The horizontal edge 64 of stay plate 60 and the horizontal edge 66 of stay plate 62 are in a coplanar relationship with the upper end surface 68 at upper end 54 of sleeve 50. Horizontal edge 64 of stay plate 60 and horizontal edge 66 of stay plate 62 are interconnected by a planar upper wall 70 of shoulder 58. Upper wall 70 has an outer surface 72 that is also disposed in a coplanar relationship with upper end surface 68 of sleeve 50. Also interconnecting stay plates 60, 62, is a lower wall 74 of shoulder 58 visible only in FIG. 4 that is disposed in parallel relationship to upper wall 70 at a vertical separation $S_v$ therefrom. Vertical separation $S_v$ may or may not be equal to horizontal separation $S_h$.

Upper wall 70, lower wall 74, and stay plates 60, 62, enclose an elongated, linear bore 76 that has a rectilinear transverse cross-sectional shape. This transverse cross-sectional shape in bore 76 is not, however, required in all instances. Instead, bore 76 need only be so sized and configured as to slidably receive a horizontal arm of the target and sign support system of FIG. 1, such as upper arm 22 and lower arm 32.

Bore 76 has an open outer end 77 remote from sleeve 50 and an open inner end 78 at upper end 54 of sleeve 50. Thus, bore 76 is capable of slidably receiving a free end of upper arm 22 or lower arm 32. Further bore 76 is capable of admitting that free end of either through bore 76 into passageway 53 of sleeve 50, if required by an intended user of the target and sign support system of FIG. 1. Upper arm 22 or lower arm 32 is maintained in any desired longitudinal position in bore 76 by a set screw 86 that is threadedly advanced through a portion of lower wall 74 of shoulder 58. Depending upon the tightness of fit achieved by bore 76 about upper arm 22 or lower arm 32, the desired longitudinal position of either in bore 76 may be maintained by binding torque produced between the interior of bore 76 and the exterior of upper arm 22 or lower arm 32 by the weight of the portion of upper arm 22 or lower arm 32 that projects outwardly from bore 76.

Apertures 79, 80, 81, formed through upper wall 70 of shoulder 58 afford access from above upper brace 24 to various longitudinal locations along bore 76. As seen only in FIG. 4, apertures 82, 83, formed through lower wall 74 of shoulder 58 correspondingly afford access from below upper brace 24 to bore 76. Apertures, such as apertures 79, 80, 81, through upper wall 70 and apertures 82, 83, through lower wall 74, facilitate one manner of injection molding of upper brace 24. With the exception of apertures 79, 81 in upper wall 70, these apertures do not significantly advance the functionality of upper brace 24 or lower brace 34 as elements of the target and sign support system of FIG. 1. Accordingly, with the exception of apertures 79, 81, those apertures will be omitted in subsequent depictions of upper brace 24 and lower brace 34.

Aperture 81 functions to facilitate the initial entry of a free end of upper arm 22 or lower arm 32 into bore 76, while aperture 79 enables a user of the target and sign support sign system of FIG. 1 to ascertain the degree to which that free end of upper arm 22 or lower arm 32 is approaching passageway 53 in sleeve 50.

Figure 5:
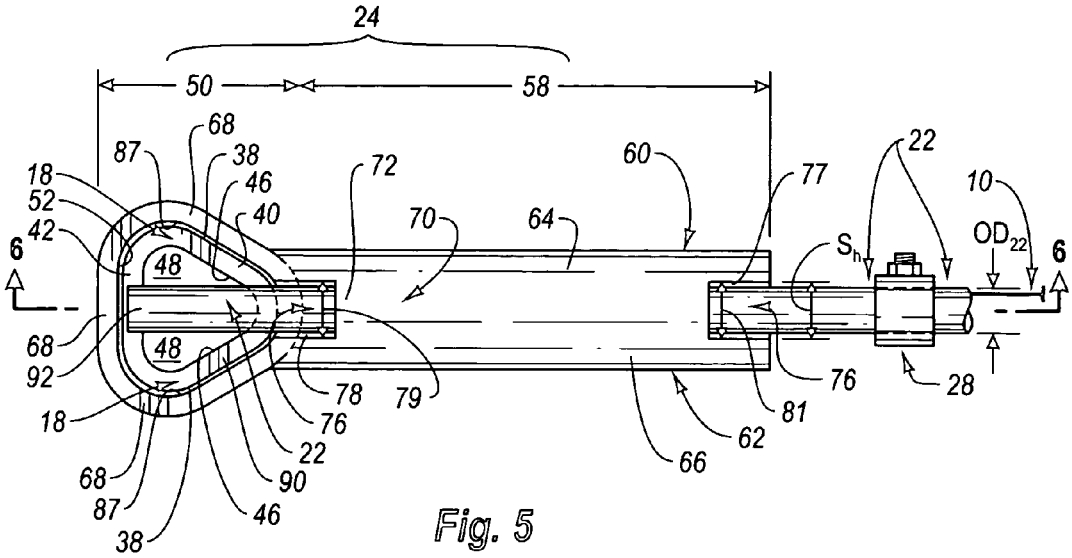
FIG. 5 is an enlarged top view of the portion of the target and sign support system of FIG. 1 at which there is mechanical interaction among the upright element, the upper horizontal arm element, and the upper brace element of that system.
Figure 6:
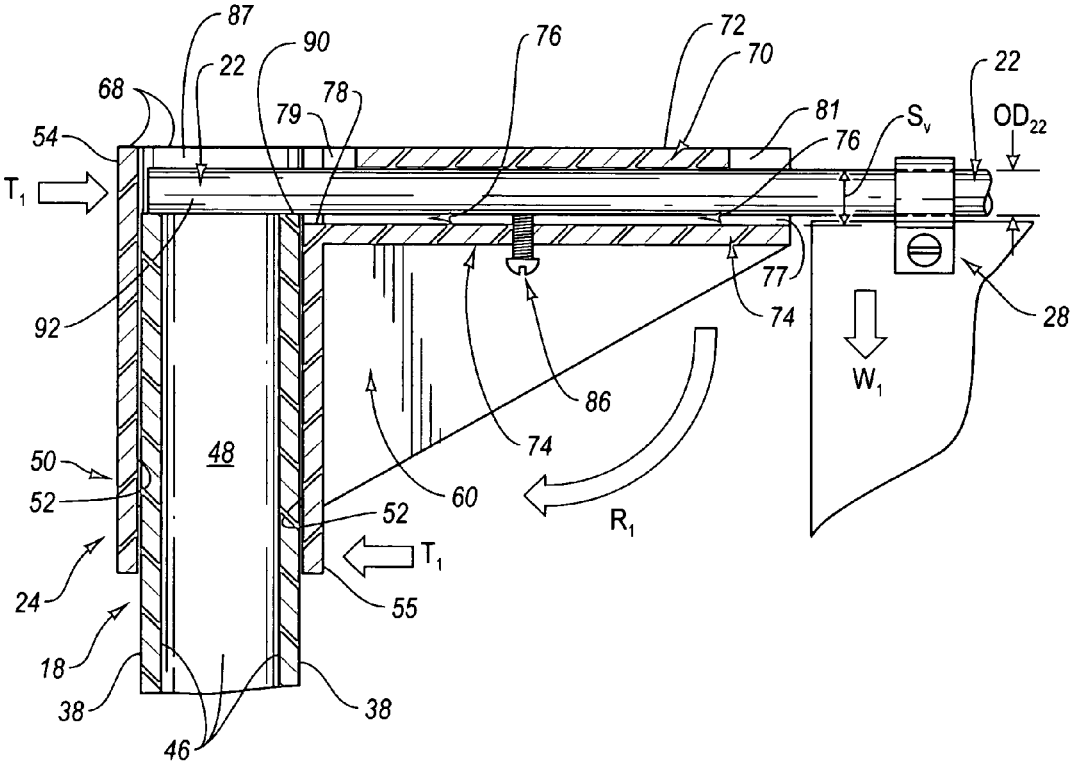
FIG. 6 is an elevation cross section view of FIG. 5 taken along section line 6-6 shown therein.

FIGS. 5 and 6 together depict the structural interactions between upper brace 24, upright 18, and upper arm 22 in the target and sign support system of FIG. 1. In that interaction, upper arm 22 is rigidly secured to upper brace 24, which is in turn slidably disposed about outer surface 38 of upright 18. The interconnection of upper arm 22 with upper brace 24 is such that the weight of upper brace 24, upper arm 22, sheet 10, and interconnecting clamps 28 comes to be borne by upper end surface 90 of upright 18.

To accomplish this interaction, an end of upper arm 22 that will be referred to as the attachment end 92 thereof is advanced through bore 76 into passageway 53 in sleeve 50 of upper brace 24. Then, upper end 26 of upright 18 is entered into passageway 53 from lower end 55 of sleeve 50, and the assembly of upper arm 22 and upper brace 24 is slid downwardly along upright 18, until attachment end 92 of upper arm 22 abuts upper end surface 90 of upright 18 as shown FIGS. 5 and 6.

Then the weight $W_1$ of sheet 10, clamps 28, upper arm 22, and upper brace 24 is in large measure carried on upper end surface 90 of upright 18 by attachment end 92 of upper arm 22. Weight $W_1$ thus causes the assembly of sheet 10, upper arm 22, and upper brace 24 to tend to rotate in a clockwise direction $R_1$ shown in FIG. 6. Rotation in direction $R_1$ converts the slidable relationship between outer surface 38 of upright 18 and inner surface 52 of sleeve 50 into a binding torque $T_1$ that is illustrated as arrows at the upper end 54 of sleeve 50 on the side thereof opposite from shoulder 58 and at lower end 55 of sleeve 50 on the side thereof adjacent to shoulder 58. When weight $W_1$ is not countered by a user manipulating the elements of the target and sign support system of FIG. 1, binding torque $T_1$ supplements the effect of attachment end 92 of upper arm 22 and upper end surface 90 of upright 18 in preventing relative downward motion of upper brace 24 along outer surface 38 of upright 18.

Alternate structural configurations are capable of performing the functions of shoulder 56 of upper brace 24. For example, an arm receiving bore, such as bore 76, could be provided at the interior of a cylindrical tube that is supported along the length thereof by a pair of stay plates, such as stay plates 60, 62. In such circumstances, horizontal edge 64 of stay plate 60 and horizontal edge 66 of stay plate 62 would terminate at the sides of that cylindrical tube, and upper wall 70 of shoulder 58 would become a rounded, semicylindrical upper enclosure for bore 76. Alternatively, such an arm receiving bore could be disposed along the upper edge of a single stay plate extending between sleeve 50 and the lower side of the tubular structure that defines the receiving bore.

Inner surface 52 of sleeve 50 of upper brace 24 is similar to and slightly larger than the cross-sectional configuration of outer surface 38 of upright 18. As a result of the non-circular cross-sectional configuration of outer surface 38 of upright 18 and the close conformity of inner surface 52 of sleeve 50 thereto, relative horizontal rotation between upper brace 24 and upright 18 about the axis of upright 18 is precluded. Nonetheless, the equilateral quality of the cross section of outer surface 38 of upright 18 and the corresponding configuration of inner surface 52 of sleeve 50 permits the disposition of upper brace 24 about upright 18 with shoulder 58 of upper brace 24 oriented at any of directions that correspond, respectively, to individual of vertices 40, 42, 44 of outer surface 38 of upright 18. Outer surface 38 of upright 18 and interior surface 52 of sleeve 50 could in the alternative be so keyed one to the other, as to require a single or a pair of specific, radial orientations of shoulder 58 of upper brace 24 relative to upright 18 in the assembled state of the target and sign support system of FIG. 1. On the other hand, a circular outer profile in upright 18 would afford no restriction to the orientation of shoulder 58 of upper brace 24 relative to upright 18, or to relative rotation therebetween.

Upper arm 22 and upper brace 24 may in many circumstances adequately support and stabilize a sheet, such as sheet 10, without the necessity of employing any lower arm and lower brace, such as lower arm 32 and lower brace 34 illustrated in FIG. 1.

The structure of lower brace 34 is identical to the structure of upper brace 24, just discussed above. The cross-sectional structure of lower arm 32 is identical to that of upper arm 22, although lower arm 32 and upper arm 22 may be of different lengths. Thus, as illustrated in detail in FIGS. 7 and 8, various elements of lower brace 34 and lower arm 32 are identified using identical reference characters as were employed earlier in identifying elements of upper brace 24 and upper arm 22 in FIGS. 5 and 6.

The assembly of lower arm 32 and lower brace 34 is slidable along outer surface 38 of upright 18, because the extent to which attachment end 92 of lower arm 32 advances through bore 76 in the direction of sleeve 50 has been limited by a user of the target and sign support system of FIG. 1 to longitudinal positions within bore 76 at which attachment end 92 of lower arm 32 does not extend into passageway 53 in sleeve 50. Thus, attachment end 92 cannot interact with upright 18. This positioning of lower arm 32 in lower brace 34 is maintained by set screw 86.

Any net weight $W_2$ of sheet 10, clamps 28, lower arm 32, and lower brace 34 not borne through upper arm 22 and upper brace 24 will tend to cause the assembly of lower arm 32 and lower brace 34 to rotate in a clockwise direction $R_2$ shown by an arrow in FIG. 8. Rotation in direction $R_2$ will in turn produce a binding torque $T_2$ shown as arrows at lower end 55 of sleeve 50 of lower brace 34 on the side thereof adjacent to shoulder 58 and at upper end 54 of sleeve 50 on the side thereof opposite from shoulder 58. Unless overcome by a user of the target and sign display system, binding torque $T_2$ will in most instances preclude any downward sliding movement of lower brace 34 along outer surface 38 of upright 18.

A similar binding torque $T_2$ will be produced between lower brace 34 and upright 18, even if lower brace 34 is disposed on outer surface 38 of upright 18 with lower end 55 of sleeve 50 uppermost and upper end 54 of sleeve 50 located therebelow. Accordingly, lower brace 34 can with full effectiveness be disposed in an upside-down relationship as compared to that illustrated in FIGS. 7 and 8.

A side view of the clamp 28 of FIG. 8 is shown in FIG. 9. A band 96 of flexible plastic, metal, or composite material is formed at a medial portion thereof into a loop 98 that is capable of encircling the outer cross section of lower arm 32, or for that matter the outer cross section of upright 18. Free ends 100, 102, of band 96 are drawn together in parallel abutment clamping opposite sides of sheet 10 by an appropriate fastening assembly, such as the threadable combination of a nut 104 and a bolt 106 that is passed through an aperture in lower edge 36 or upper edge 30 of sheet 10. Clamp 28 thus affords a nondestructively assemblable and disassemblable means for securing sheet 10 to each of upper arm 22 and lower arm 32.

Nonetheless, targets or signs, such as sheet 10, may be equipped with one or more open-ended sleeves that are permanently secured along one or both of upper edge 30 and lower edge 36 and that are of sufficient transverse cross-sectional extent as to slidably receive a stabilizing member, such as upper arm 22 or lower arm 32. In such circumstances, upper arm 22 and lower arm 32 can be entered into the sleeves at the edges of sheet 10, eliminating the need for distinct attachment structures, such as clamp 28.

On the other hand, in using the target and sign support system of FIG. 1 to display selected types of substrates, such as sheet 10, less substantial types of attachment structures may be utilized in place of clamps 28. Such attachment structures may be readily available household or desk supply articles, such as binder clamps, twine, and adhesive tape.

Lower arm 32 and upper arm 22 can be configured as shown in FIG. 6 as solid cylindrical rods made of any suitable sturdy plastic, metal, or composite material. Alternatively, each of lower arm 32 and upper arm 22 may be tubular in nature. Also, lower arm 32 and upper arm 22 may be configured with non-circular outer cross-sectional profiles, provided that any such non-circular outer cross-sectional profile does not prevent lower arm 32 or upper arm 22 from being slidably received in bore 76 in lower brace 34 or upper brace 24.

Figure 10:
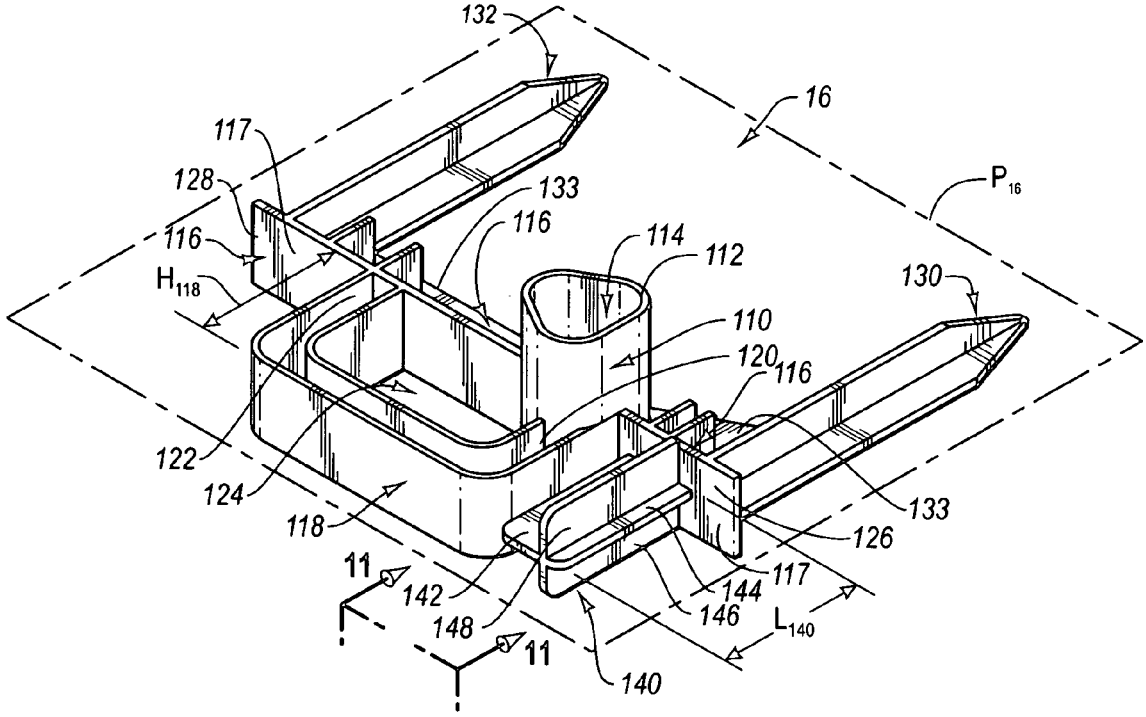
FIG. 10 is a perspective view of a first embodiment of a base element for the target and sign support system of FIG. 1.

FIG. 10 presents a perspective view of a first embodiment of base 16 of the target and sign support system of FIG. 1. Base 16 may be manufactured by an injection molding process using a plastic, metal, or composite material. In overview, base 16 is a complexly-configured structure having diverse elements that are arrayed in a generally coplanar disposition which is identified in FIG. 10 as plane $P_{16}$ of base 16. Base 16 accordingly has an upper face that is visible from one side of plane $P_{16}$ and that is shown in FIG. 7. A lower face of base 16 on the opposite side of plane $P_{16}$ is not visible in FIG. 7, but it is the lower face of base 16 that rests on hard surface 12 in FIG. 1.

According to one aspect of the target and support sign system of FIG. 1, base 16 includes alternative capture means for slidably receiving the lower end of upright 18 and maintaining upright 18 in a perpendicular orientation. The alternative capture means includes a matched pair of structures. One of these structures is a first capture means on the upper face of base 16 for receiving lower end 20 of upright 18 and maintaining upright 18 in a perpendicular orientation to plane $P_{16}$ of base 16, when the lower face of base 16 rests on a hard surface or the ground. The other of these structures is a second capture means for receiving lower end 20 of upright 18 and maintaining upright 18 in coplanar orientation with plane $P_{16}$ of base 16 when base 16 is used on soft ground in a manner to be described subsequently.

A tubular upright receiving socket 110 projects perpendicularly upward from plane $P_{16}$ of base 16. Receiving socket 110 has an upper end surface 112 and an interior transverse cross-sectional configuration that is closely similar to that of sleeve 50 of each of upper brace 24 and of lower brace 34. Consequently, receiving socket 110 encloses a passageway 114 so shaped as to slidably receive and retain lower end 20 of upright 18 in the manner illustrated in FIG. 1 in a perpendicular orientation to plane $P_{16}$ of base 16.

The end of receiving socket 110 opposite from upper end surface 112 is secured in perpendicular relationship to an elongated footing 116 that functions as a unifying spine for base 16. All other components of base 16 project from footing 116 in plane $P_{16}$ of base 16.

For example, on a first longitudinal edge 117 of footing 116 is attached a handle 118 of transverse I-beam cross section. Handle 118 has a first end 120 and a second end 122. First end 120 joins footing 116 at the location on longitudinal edge 117 of footing 116 from which receiving socket 110 also projects. Second end 122 of handle 118 joins footing 116 remotely from receiving socket 110. Footing 116 and handle 118 thus together defines a handle loop 124. Handle 118 extends to a overall height $H_{118}$ beyond footing 116. Footing 116 extends beyond first end 120 of handle 118 to a first end 126 and beyond second end 122 of handle 118 to a second end 128. Thus, handle 118 correspondingly is located generally centrally along the length of footing 116.

Substantially identical, parallel-disposed, pointed stakes 130, 132, project in plane $P_{16}$ of base 16 from a second longitudinal edge 133 of footing 116 opposite from handle 118. Stake 130 is at first end 126 of footing 116, while stake 132 is at second end 128 of footing 116. Being coplanar and of substantially similar thicknesses, footing 116, handle 118, and stakes 130, 132, together stabilize receiving socket 110 whenever base 16 rests upon a flat hard surface upholding upright 18 in the manner shown in FIG. 1, which is presented in enlarged detail also in FIG. 12. In such a role, stakes 130, 132 need not be pointed and could be referred to as stabilizing feet. On such occasions, additional stability can be afforded to upright 18 by the disposition of a heavy counterweight 134 shown in phantom in FIG. 12 across the end of either or both of those stabilizing feet.

An alternative mode of use of base 16 to uphold upright 18 on soft ground is enabled by a mounting post 140 shown in FIG. 10 as projecting from first longitudinal edge 117 of footing 116 between first end 120 of handle 118 and first end 126 of footing 116. Mounting post 140 has a length $L_{140}$ comparable, but not necessarily equal, to height $H_{118}$ of handle 118.

Figure 11:
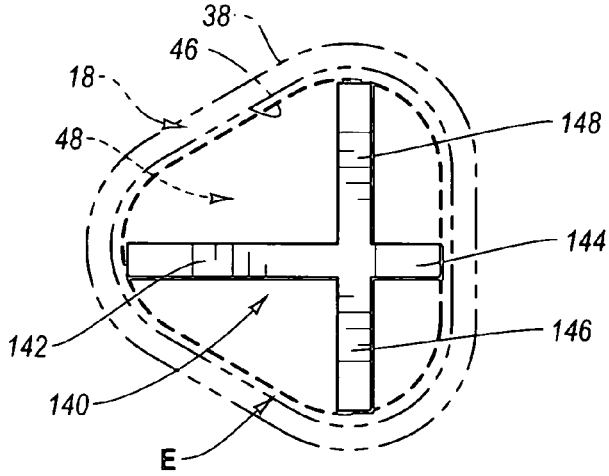
FIG. 11 is a diagrammatic depiction of the relative shape and size of the cross section of the upright element of the target and sign support system of FIG. 1 in phantom superimposed on a top view of the mounting post of the base element shown in FIG. 10.

The transverse cross-sectional configuration of mounting post 140 is best appreciated by reference to FIG. 11. There, mounting post 140 can be seen to comprise a cross-shaped arrangement of radially outwardly projecting ribs 142, 144, 146, 148. The respective lengths of ribs 142, 144, 146, 148 are selected so that the extreme ends of each lie on a conceptual envelope E that is slidably receivable in passageway 48 at lower end 20 of upright 18, which is shown by way of comparison in phantom in FIG. 11.

Figure 12:
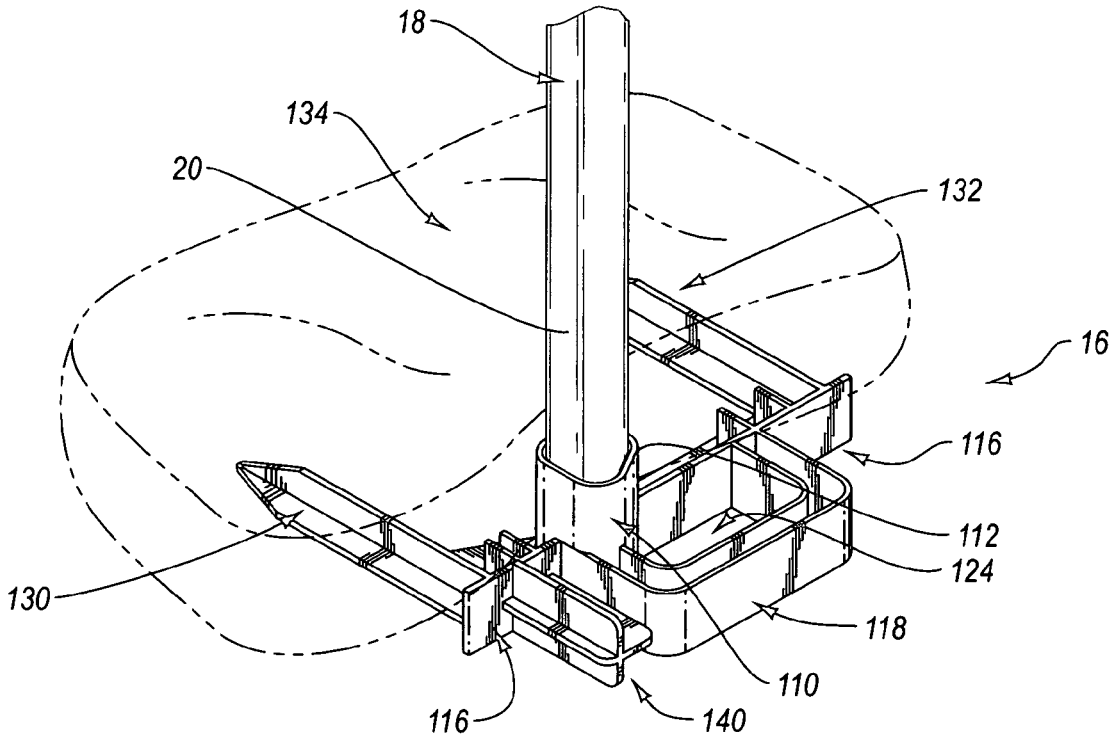
FIG. 12 is a perspective view of the base element of FIG. 10 in a first mode of assembly with the lower end of an upright element of a target and sign support system incorporating teachings of the present invention, wherein that system is supported on a hard surface.
Figure 13:
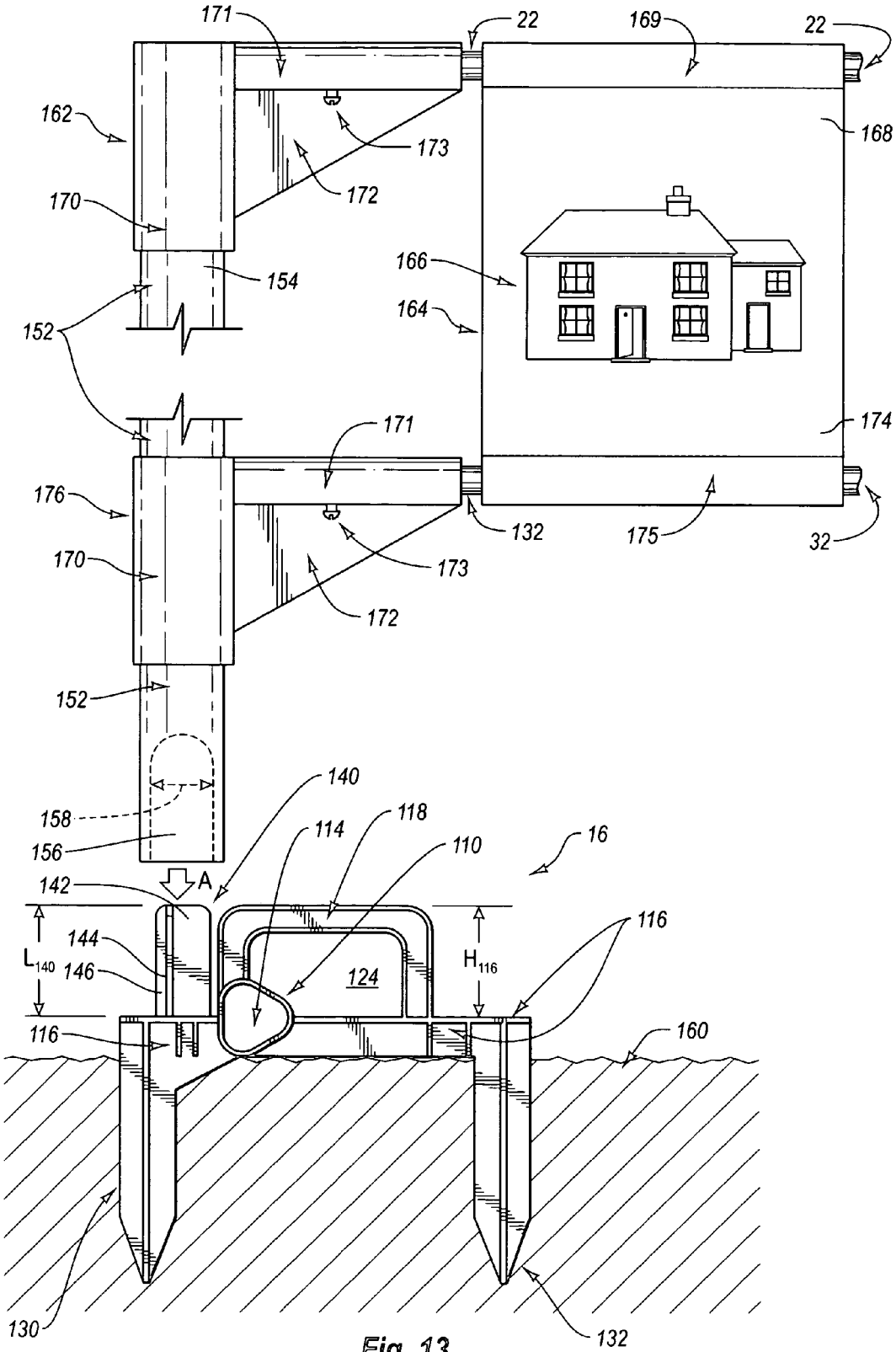
FIG. 13 is an elevation view in partial disassembly of the base element of FIG. 10 in a second mode of assembly with other elements of a target and sign support system incorporating teachings of the present invention, wherein that system is supported on soft ground.

If upright 18 is a solid rather than a tubular structure, then the formation in lower end 20 of a post receiving recess configured to accept the transverse cross section of mounting post 140 will enable that solid version of upright 18 also to be used with base 16, both in the mode of assembly already illustrated in FIG. 12 and in an alternative mode of assembly that is illustrated in FIG. 13.

Thus, the target and sign support system illustrated in FIG. 13 includes a solid upright 152 that has an upper end 154 and a lower end 156. Formed in lower end 156 of upright 152 is a post receiving socket 158 that is configured to slidably accept the transverse cross section of mounting post 140. As shown in FIG. 13, base 16 can be utilized to uphold upright 152 above a soft piece of ground 160. With plane $P_{16}$ of base 16 maintained perpendicular to ground 160, first stake 130 and second stake 132 are driven into ground 160 until footing 116 encounters ground 160. Then, lower end 156 of upright 152 is lowered onto mounting post 140 as indicated in FIG. 13 by arrow A, and mounting post 140 is received in recess 158. Equally efficacious would be the lowering onto mounting post 140 of a tubular upright, such as upright 18 illustrated in FIG. 2. Then mounting post 140 would enter passageway 48 from lower end 20 of upright 18.

The manner of using base 16 illustrated in FIG. 13 obviates the need for any counterweight, such as counterweight 134 illustrated in FIG. 12, and is particularly suited for utilizing the target and sign support system on ground with an uneven surface. To disassemble or move the target and sign support system from the mode of assembly shown in FIG. 13, handle 118 is used to withdraw first stake 130 and second stake 132 from ground 160 simultaneously.

At the end of upright 152 remote from base 16, an upper brace 162 is used with upper arm 22 to support a sheet 164 bearing signage 166. Upper edge 168 of sheet 164 is permanently provided with a sleeve 169 that receives upper arm 22 for that purpose. Upper brace 162 includes a sleeve 170 that slidably encircles upright 152 and a tubular shoulder 171 supported by a single stay plate 172. A set screw 173 maintains the end of upper arm 22 in upper brace 162 at a longitudinal position therein that supports the weight of upper brace 162, upper arm 22, and sheet 164 from the top of upright 152 that is not visible in FIG. 13. To stabilize sheet 164, lower edge 174 thereof is provided with a sleeve 175. Sleeve 175 slidably receives lower arm 32 that is in turn supported by a lower brace 176 that is identical in structure to upper brace 162.

Many variations are possible in the design of base 16. Handle 118 could be formed without exterior recesses, streamlining the appearance of base 16. Passageway 114 in receiving socket 110 can be provided with an open or a closed lower end. Mounting post 140 can be configured as a solid or a hollow stub having an exterior transverse profile corresponding to conceptual envelope E shown in FIG. 11. Alternatively, mounting post 140 could be replaced by a structure such as receiving socket 110, or receiving socket 110 could be replaced by a structure as mounting post 140.

Figure 14:
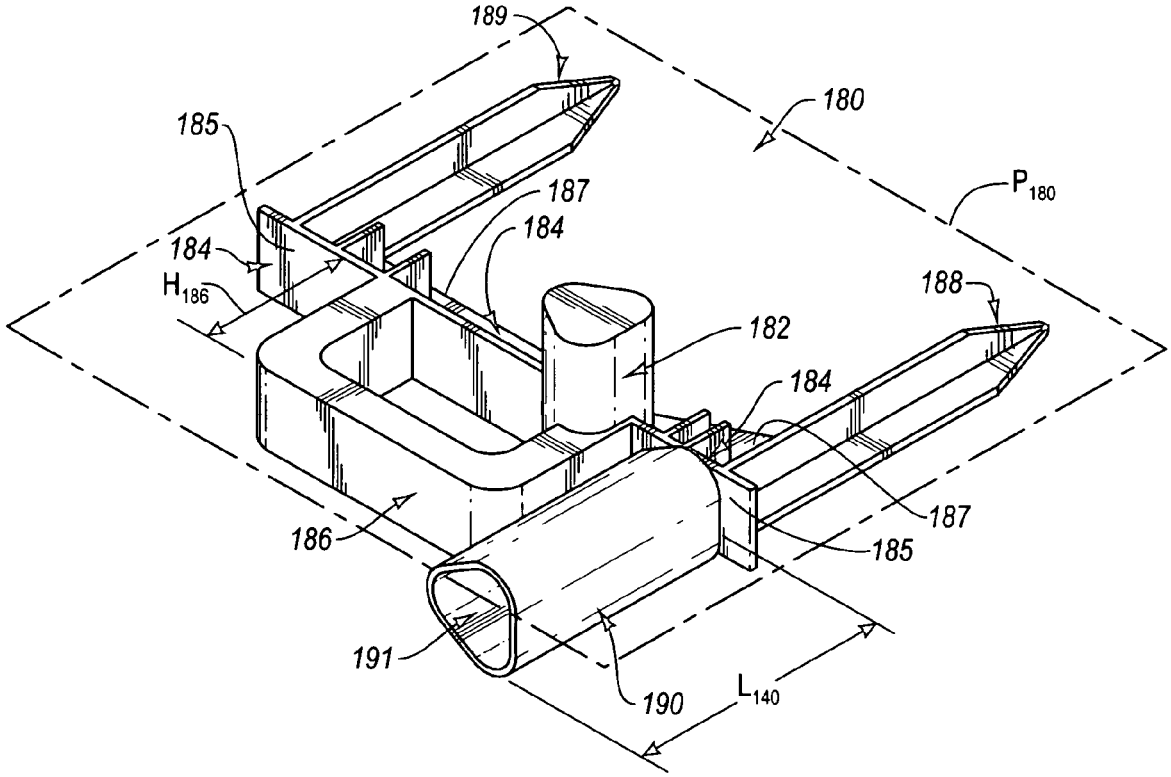
FIG. 14 is a perspective view of a second embodiment of a base element for a target and sign support system incorporating teachings of the present invention.

FIG. 14 presents a perspective view of a second embodiment of a base for the target and sign support system of FIG. 1 embodying some of these alternate design features. Seen thus in FIG. 14 is a base 180 that is a complexly-configured structure having diverse elements that are arrayed in a generally coplanar disposition that is identified in FIG. 14 as plane $P_{180}$ of base 180. Base 180 accordingly has an upper face that is visible from one side of plane $P_{180}$ and that is shown in FIG. 14. A lower face of base 180 on the opposite side of plane $P_{180}$ is not visible in FIG. 14, but it is the lower face of base 180 that would, for example, rest on hard surface 12 in FIG. 1.

According to one aspect of the target and sign support system of FIG. 1, base 180 includes alternative capture means for slidably receiving the lower end of a tubular upright, such as upright 18, or a solid upright, such as upright 152, and maintaining that upright in a perpendicular orientation. The alternative capture means of base 180 includes a matched pair of structures. One of these structures is a first capture means on the upper face of base 180 for receiving the lower end of an upright and maintaining the upright in a perpendicular orientation to plane $P_{180}$ of base 180, when the lower face of base 180 rests on a hard surface or the ground. The other of these structures is a second capture means for receiving the lower end of an upright and maintaining that upright in coplanar orientation with plane $P_{180}$ of base 180, when base 180 is used on soft ground.

A mounting post 182 projects perpendicularly upward from plane $P_{180}$ of base 180. The transverse cross-sectional configuration of mounting post 182 is slidably receivable in the passageway in a tubular upright or a recess in the lower end of a solid upright of the type to be used with the target and sign support system of FIG. 1. Consequently, mounting post 182 is capable of slidably receiving and retaining the lower end of an upright in the manner illustrated in FIG. 1 in a perpendicular relation to plane $P_{180}$ of base 180.

Mounting post 182 is secured in perpendicular relationship to an elongated footing 184 that functions as a unifying spine for base 180. All other components of base 180 project from footing 184 in plane $P_{180}$ of base 180.

For example, on a first longitudinal edge 185 of footing 184 is attached a handle 186 of solid construction that is located generally centrally along the length of footing 184. Handle 186 extends to an overall height $H_{186}$ beyond footing 184. Substantially identical, parallel-disposed, pointed stakes 188, 189 project in plane $P_{180}$ of base 180 from a second longitudinal edge 187 of footing 184 opposite from handle 186. Being coplanar and of substantially similar thickness, footing 184, handle 186, and stakes 188, 189, together stabilize mounting post 182 whenever base 180 rests upon a flat hard surface upholding an upright in the manner shown in FIG. 1. In such a role, stakes 188, 189 need not be pointed and could be referred to as stabilizing feet.

An alternative mode of using base 180 to uphold an upright on soft ground is enabled by a tubular receiving socket 190 shown in FIG. 14 as projecting from first longitudinal edge 185 of footing 184 in plane $P_{180}$ of base 180. Receiving socket 190 has a length $L_{190}$ that is shown as being greater than height $H_{186}$ of handle 186. Receiving socket 190 has an interior transverse cross-sectional configuration that is closely similar to the outer surface of any upright intended for use with base 180. Consequently, receiving socket 190 encloses a passageway 191 so shaped as to slidably receive and retain the lower end of such an upright in the manner illustrated in FIG. 1, in a coplanar relation to plane $P_{180}$ of base 180.

Figure 15:
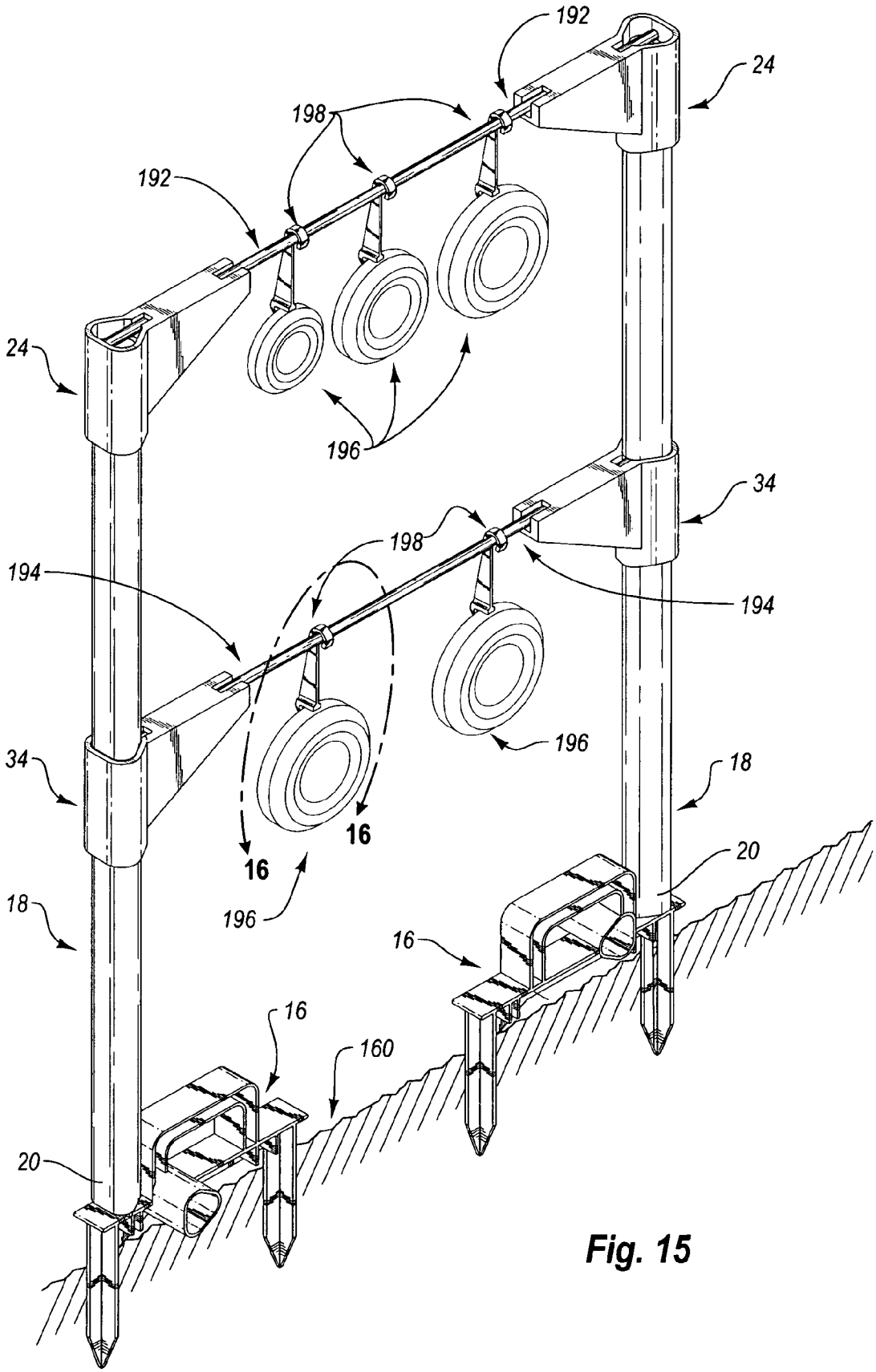
FIG. 15 is a perspective view of a second embodiment of elements of a target and sign support system embodying teachings of the present invention assembled on soft ground to uphold clay targets of the type routinely cast for firearm practice from trap or skeet shoot target equipment.

FIG. 15 depicts a pair of bases 16 utilized in the assembly mode of FIG. 13 to uphold above soft ground 160 a second embodiment of a target and sign support system. Each base 16 upholds a respective upright 18, and between uprights 18 an upper arm 192 and a lower arm 194. Upper arm 192 and lower arm 194 are similar, but possibly longer than, upper arm 22 and lower arm 32, respectively, shown in FIG. 1. Each end of upper arm 192 is secured by a respective upper brace 24 to an associated upright 18, whereby a portion of the weight of upper arm 192 and any article suspended therefrom is borne by each of uprights 18 and an associated base 16. Similarly, each end of a lower arm 194 is secured by a respective lower brace 34 to an associated upright 18. Thus, the weight of lower arm 194 and any article suspended therefrom is borne in part by each of uprights 18 and an associated base 16. The support of upper arm 192 and lower arm 194 at both ends renders the target and sign support system illustrated in FIG. 10 particularly suited to the support of wide or heavy targets and signs.

As illustrated in FIG. 15, various sizes of clay targets 196 of the type routinely cast for rifle practice from trap or skeet shooting target equipment are suspended from each of upper arm 192 and lower arm 194. Each clay target 196 is suspended from a respective of upper arm 192 or lower arm 194 by a target hanger 198 of universal design that is capable of accommodating clay targets 196 of any size.

Figure 16:
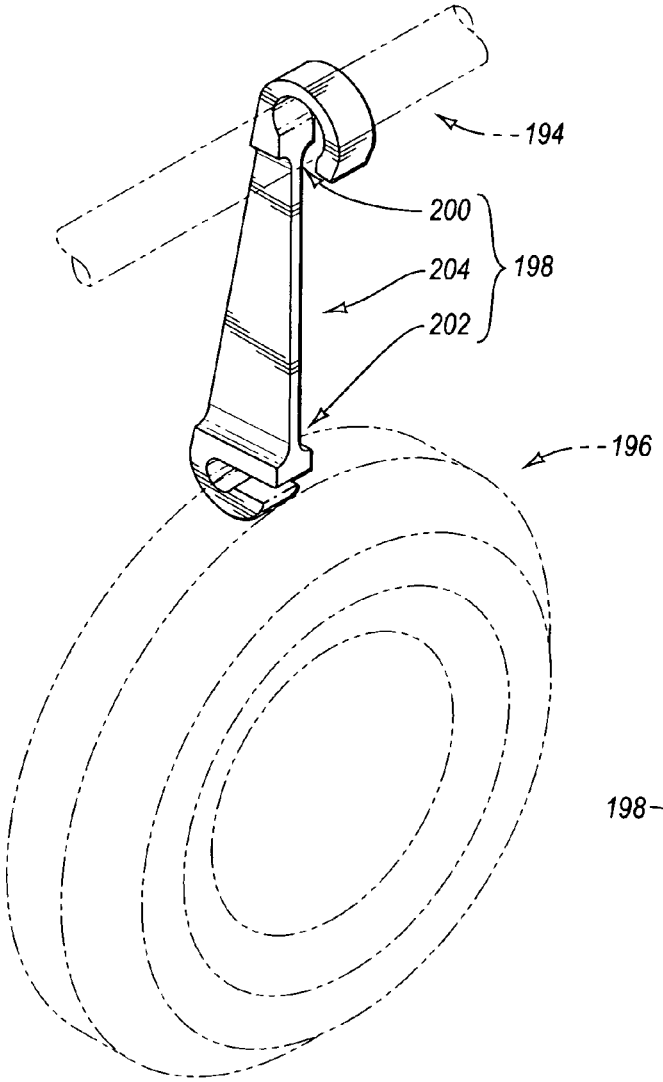
FIG. 16 is an enlarged perspective view of a single target hanger element of the target and sign support system of FIG. 15 with the lower arm element of that system and a clay target shown in phantom.

An enlarged view of one such target hanger 198 suspending a clay target 196 from lower arm 194 is illustrated in FIG. 16. There clay target 196 and lower arm 194 are shown in phantom. In front view, target hanger 198 assumes a barbell-type appearance having an upper lobe 200 and a lower lobe 202 interconnected by a slim shaft 204. Upper lobe 200 interacts with lower arm 194, while lower lobe 202 interacts with the rim of clay target 196. As best appreciated by reference to FIG. 16, when the lip of clay target 196 is engaged by lower lobe 202 of target hanger 198, the transverse width of shaft 204 in the plane of the major surface of clay target 196 is small relative to the width of upper lobe 200 in the plane of the major surface of clay target 196. Similarly, when the lip of clay target 196 is engaged by lower lobe 202 of target hanger 198, the transverse width of shaft 204 in the plane of the major surface of clay target 196 is small relative to the width of lower lobe 202 in the plane of the major surface of clay target 196. This design in shaft 204 minimizes the profile of target hanger 198 presented to a target shooter firing at clay target 196, thereby to optimize the likelihood that target hanger 198 will be reusable on subsequent targeting occasions, even after clay target 196 has been struck and demolished by that target shooter. As thus suspended, the major surface of clay target 196 extends away from upper lobe 200 in a vertical orientation when hanger 198 and clay target 196 are upheld by lower arm 194. The face of clay target 196 not visible in FIG. 16 can be oriented toward a marksman merely by reversing the relationship of upper lobe 200 to lower arm 194 from that shown in FIG. 16.

Figure 17:
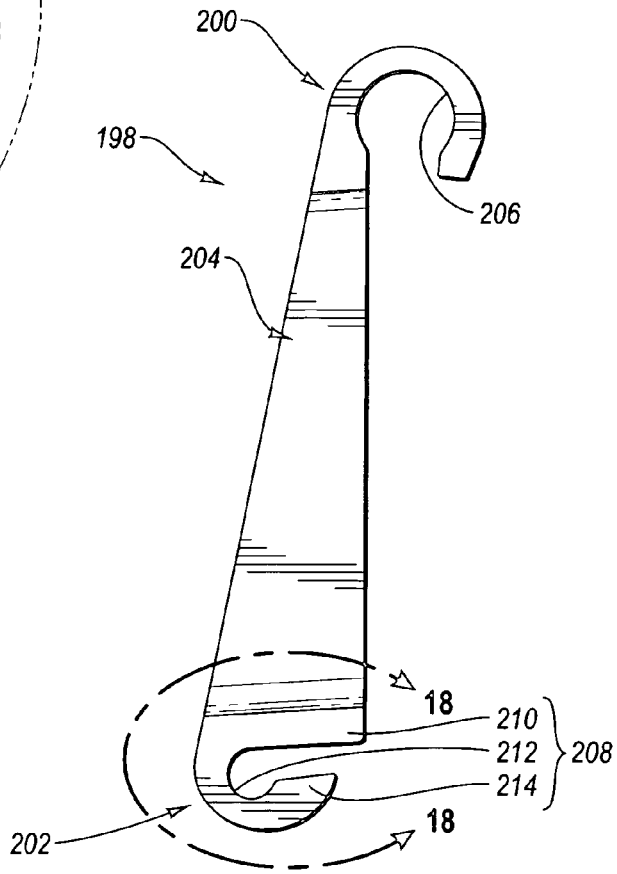
FIG. 17 is a side view of the target hanger element of FIG. 16.

Additional insights into the structure of target hanger 198 are derived from the elevation side view thereof presented in FIG. 17. Upper lobe 200 is formed into a hook 206 that is sized to accommodate the cross-sectional extent of the exterior of lower arm 194 or of upper arm 192. As illustrated, in target hanger 198, the opening into hook 206 is on the same side of shaft 204 as is the entrance that will be discussed in detail below into lower lobe 202. According to one aspect of the target and sign support system of FIG. 15, lower lobe 202 includes resilient means for gripping the lip of a clay target with the major surface of the clay target extending away from upper lobe 200 in a vertical orientation when hanger 198 and the clay target are suspended from a horizontal support. Lower lobe 202 is integrally formed into a resilient, C-shaped clasp 208. The operation of clasp 208 is best understood by reference to the sequence of enlarged views presented in FIGS. 18-20.

Figure 18:
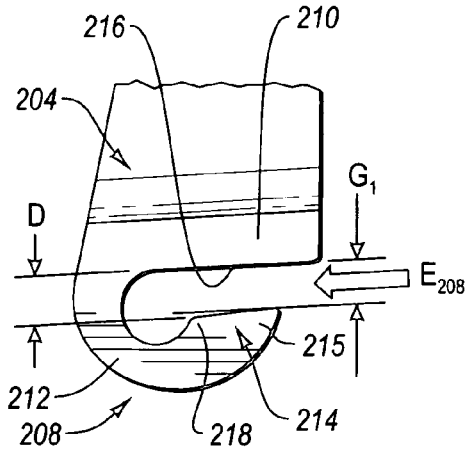
FIG. 18 is an enlarged view of the clasp of the target hanger element of FIG. 17 shown in a relaxed state thereof.

In FIG. 18, clasp 208 is shown to include a clamp plate 210 that is oriented generally parallel to the ground when target hanger 198 is suspended by hook 206 from a horizontal structure, such as lower arm 194, upper arm 192, or even twine, wire, or rope stretched between verticals, such as trees, posts, or uprights 18 and uprights 152 of the target and sign support system of FIG. 1. One end of clamp plate 210 is attached by a curved neck 212 to a gripping jaw 214.

The entrance $E_{208}$ into clasp 208 is between clasp plate 210 and the free end 215 of gripping jaw 214. In the relaxed state of clasp 208, free of any externally imposed forces, free end 215 of gripping jaw 214 is opposed to and separated from lower surface 216 of clasp plate 210 by a gap $G_1$ of about 0.130±0.005 inches. This by design is less than the thickness of any lip encircling the major surface of most commonly available clay targets 196. The surface of jaw 214 opposing clasp plate 210 is not strictly parallel to lower surface 216 of clamp plate 210 in the relaxed state of clamp 208. That surface of jaw 214 has a length of about 0.230±0.005 inches, whereby at the inner end 218 of jaw 214, jaw 214 is separated from clasp plate 210 by a distance D that is equal to about 0.145±0.005 inches. Neck 212 has a typical minimum thickness of about 0.072±0.005 inches.

Figure 19:
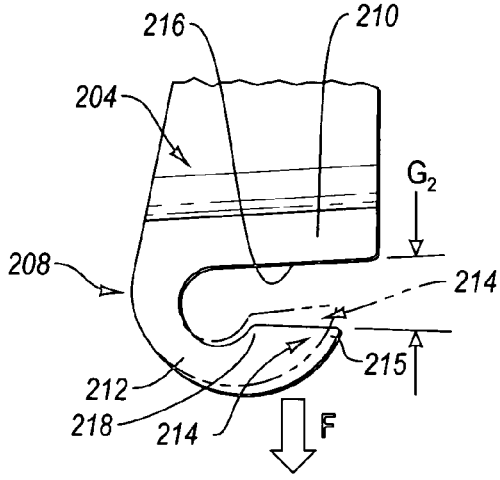
FIG. 19 is a view of the clasp of FIG. 18 under the influence of an externally imposed force that tends to open the clasp.

FIG. 19 illustrates that neck 212 of clasp 208 is sufficiently flexible to permit jaw 214 to be rotated away from lower surface 216 of clasp plate 210 by a force F applied to free end 215 of jaw 214. Under such conditions, the separation between free end 215 of jaw 214 and lower surface 216 of clasp plate 210 increases to a gap $G_2$ that is larger than gap $G_1$ associated with the relaxed state of clasp 208. Gap $G_2$ is also larger than the thickness of any lip encircling most commonly available clay targets 196. If force F is removed, the resilience of neck 212 returns jaw 214 to the position thereof associated with the relaxed state of clasp 208, which is shown by comparison in phantom in FIGS. 17 and 18. Accordingly, jaw 214 can be drawn away from clasp plate 210 as required to accommodate between jaw 214 and lower surface 216 of clasp plate 210 the lip of any clay target 196 shown in FIGS. 15 and 16.

Figure 20:
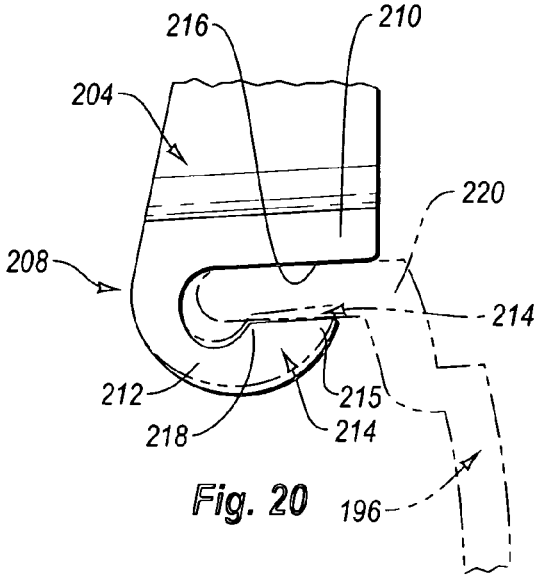
FIG. 20 is a view of the clasp of FIGS. 18 and 19 resiliently engaging the lip of a clay target in the manner shown in FIG. 16.

As shown in FIG. 20, the necessary corresponding widening of the separation between jaw 214 and lower surface 216 of clamp plate 210 is actually effected by forcing a lip 220 of clay target 196 into entrance $E_{208}$ to clasp 208 in the space between jaw 214 and lower surface 216 of clasp plate 210. Whatever the thickness of lip 220, jaw 214 will thereafter resiliently urge lip 220 upwardly against lower surface 216 of clasp plate 210. The assembly of target hanger 198 and clay target 196 can then be suspended from a horizontal structure using hook 206.

Target hanger 198 can be injection molded from plastic or metal materials possessed of sufficient elastic resilience and memory as can be used to produce a clasp 208 that functions in the manner described above. Various types of polypropylene serve well in this role. Alternatively, target hanger 198 can be manufactured by other methods and from composite materials.

Many design variations in target hanger 198 are conceivable that would not derogate from satisfactory functioning. For example, while hook 206 and clasp 208 are illustrated as open toward the same edge of shaft 204, an arrangement of these components of target hanger 198 is possible so that hook 206 and clasp 208 would open toward opposite edges of shaft 204.

Further, jaw 214 could be configured as a pair of similar, parallel-disposed jaws neither of which would directly oppose clasp plate 210. Such an arrangement would permit clasp 208 to engage lip 220 of clay target 196 at three distinct circumferential locations, plate 210 on the upper surface of lip 220 and the pair of distinct bifurcated portions of jaw 214 on the lower surface of lip 220, one to either side of plate 210. This would enhance the stability of the gripping action effected.

The invention may be embodied in other specific forms without departing from spirit or essential characteristics thereof. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within the scope thereof.

What is claimed is:

1. A system for supporting a target, said system comprising:

(a) an upright having upper and lower ends;

(b) a base capable of stable disposition both on a hard and on a soft surface, said base comprising alternative capture means for slidably receiving the lower end of said upright and maintaining said upright in a perpendicular orientation;

(c) an elongated horizontal arm from which to suspend the target;

(d) a brace positionable on said upright while supporting said horizontal arm in a perpendicular relation thereto; and (e) a hanger adapted to suspend from said horizontal arm a clay target of the type cast by trap and skeet shooting equipment and displaying a major surface circumscribed at the periphery thereof by a perpendicular lip, said hanger comprising:

(i) an upper lobe adapted to interact with said horizontal arm to suspend the hanger downwardly therefrom;

(ii) an elongated shaft having first and second ends, said shaft being attached at said first end thereof to said upper lobe; and (iii) a lower lobe of unitary construction rigidly attached to said second end of said shaft, said lower lobe comprising resilient means for gripping the lip of the clay target at a chosen location along the lip with a compressive force directed parallel to said shaft, said resilient means comprising a clasp adapted to receive the lip of the clay target and having an entrance smaller than the thickness of the lip.

2. A system as recited in claim 1, wherein said upper lobe of said hanger is configured as an open hook adapted to capture said horizontal arm.

3. A system as recited in claim 1, wherein the transverse width of said shaft of said hanger is small relative to the width of said upper lobe of said hanger measured parallel to said width of said shaft.

4. A system as recited in claim 1, wherein the transverse width of said shaft of said hanger is small relative to the width of said lower lobe of said hanger measured parallel to said width of said shaft.

5. A system as recited in claim 1, wherein said upper lobe of said hanger, said elongated shaft of said hanger, and said lower lobe of said hanger are integrally formed from a resilient plastic material.

6. A system as recited in claim 1, wherein said clasp of said hanger comprises:

(a) a clamp plate attached to said second end of said shaft of said hanger and oriented generally horizontally when said hanger is suspended from said horizontal arm, said clamp plate having an inner end and an outer end;

(b) a gripping jaw having an inner end and an outer end and being disposed opposing said clamp plate with said outer end of said gripping jaw facing said outer end of said clamping plate to define therebetween said entrance into said clasp of said hanger; and (c) a resiliently deformable neck interconnecting said inner end of said clamp plate with said inner end of said gripping jaw.

7. A system as recited in claim 1, wherein said upper lobe of said hanger is configured as an open hook adapted to capture said horizontal arm, and the opening to said hook is on the same side of said shaft of said hanger as said entrance to said clasp of said hanger.

8. A system as recited in claim 1, wherein said brace comprises:

(a) a sleeve proportioned to slidably encircle the outer surface of said upright; and (b) a tubular shoulder projecting in a perpendicular relation to said sleeve from the exterior thereof, said shoulder enclosing a horizontal arm receiving bore, said receiving bore having:

(i) an open outer end remote from said sleeve; and (ii) a transverse cross section configured to slidably receive an end of said horizontal arm.

9. A system as recited in claim 8, wherein said receiving bore of said brace comprises an inner end opening into the interior of said sleeve, whereby an end of said horizontal arm is selectively enterable through said receiving bore into the interior of said sleeve, thereby to support from the top of said upright said brace and said horizontal arm.

10. A system as recited in claim 8, wherein said sleeve of said brace is so proportioned as to be upheld at a predetermined position on said upright by binding torque imposed on the outer surface of said upright by the interior of said sleeve, said binding torque arising between said brace and said upright due to the weight of said horizontal arm in said receiving bore of said brace.

11. A system as recited in claim 8, wherein said receiving bore of said brace is so proportioned as to retain said horizontal arm at a predetermined position therein by binding torque imposed on the interior of said receiving bore by the exterior of said horizontal arm, said binding torque arising between said horizontal arm and said shoulder of said brace due to the weight of the portion of said horizontal arm extending outwardly from said receiving bore of said brace.

12. A system as recited in claim 8, wherein said brace further comprises means for fixing the longitudinal position within said receiving bore of said end of said horizontal arm advanced thereinto.

13. A system for supporting a target, said system comprising:

(a) an upright having upper and lower ends;

(b) a base capable of stable disposition both on a hard and on a soft surface, said base comprising alternative capture means for slidably receiving the lower end of said upright and maintaining said upright in a perpendicular orientation;

(c) an elongated horizontal arm from which to suspend the target;

(d) a brace slidable on the outer surface of said upright, said brace comprising a tubular shoulder projecting in perpendicular relation to said upright when said brace is slidably disposed thereupon, said shoulder enclosing a horizontal arm receiving bore having a transverse cross section configured to slidably receive one end of said horizontal arm; and (e) a hanger adapted to suspend from said horizontal arm a clay target of the type cast by trap and skeet shooting equipment and displaying a major surface circumscribed at the periphery thereof by a perpendicular lip, said hanger being of unitary molded construction and comprising:

(i) an upper lobe adapted to interact with said horizontal arm to suspend said hanger therefrom;

(ii) an elongated shaft having first and second ends, said shaft being attached at said first end thereof to said upper lobe; and (iii) a lower lobe attached to said second end of said shaft and comprising resilient means for gripping the lip of the clay target at a chosen location along the lip with a compressive force directed parallel to said shaft.

14. A system as recited in claim 13, wherein the transverse width of said shaft is small relative to the width of said upper lobe measured parallel to said width of said shaft.

15. A system as recited in claim 13, wherein the transverse width of said shaft is small relative to the width of said lower lobe measured parallel to said width of said shaft.

16. A system as recited in claim 13, wherein said upper lobe, said elongated shaft, and said lower lobe are integrally formed from a resilient plastic material.

17. A system as recited in claim 13, wherein said resilient means comprises a clasp adapted to receive the lip of the clay target.

18. A system as recited in claim 17, wherein said clasp has an entrance smaller than the thickness of the lip at the chosen location along the lip.

19. A system as recited in claim 17, wherein said clasp comprises:

(a) a clamp plate attached to said second end of said shaft and oriented generally horizontally when said hanger is suspended from the horizontal support, said clamp plate having an inner end and an outer end;

(b) a gripping jaw having an inner end and an outer end and being disposed opposing said clamp plate with said outer end of said gripping jaw facing said outer end of said clamping plate to define therebetween said entrance into said clasp; and (c) a resiliently deformable neck interconnecting said inner end of said clamp plate with said inner end of said gripping jaw.

20. A system as recited in claim 17, wherein said upper lobe is configured as an open hook adapted to capture said horizontal arm.

21. A system as recited in claim 20, wherein the opening to said hook is on the same side of said shaft as said entrance to said clasp.

22. A system as recited in claim 13, wherein said base comprises:

(a) an elongated footing having opposed longitudinally extending first and second edges;

(b) parallel first and second stakes projecting from said first edge of said footing, said first and second stakes and said footing defining a plane of said base, and said base thereby having an upper face and a lower face on opposite sides of said plane thereof;

(c) a receiving socket upstanding from said footing perpendicular to said plane of said base, the interior cross-sectional shape of said receiving socket being similar to and larger than the exterior cross-sectional shape of the lower end of said upright;

(d) a mounting post projecting perpendicular to said footing from said second edge thereof in said plane of said base, said mounting post being slidably receivable in the lower end of said upright; and (e) a handle projecting from said second edge of said footing in said plane of said base.

23. A system as recited in claim 22, wherein the length of said first stake of said base is equal to the length of said second stake of said base.

24. A system as recited in claim 22, wherein the transverse cross-sectional configuration of said mounting post of said base comprises a cross-shaped arrangement of a plurality of radially outwardly projecting ribs.

25. A system for supporting a target, said system comprising:

(a) an upright having upper and lower ends;

(b) a base capable of stable disposition both on a hard and on a soft surface, said base comprising alternative capture means for slidably receiving the lower end of said upright and maintaining said upright in a perpendicular orientation;

(c) an elongated horizontal arm from which to suspend the target;

(d) a brace slidable on the outer surface of said upright, said brace comprising a tubular shoulder projecting in perpendicular relation to said upright when said brace is slidably disposed thereupon, said shoulder enclosing a horizontal arm receiving bore having a transverse cross section configured to slidably receive one end of said horizontal arm; and (e) a hanger adapted to suspend from said horizontal arm a clay target of the type cast by trap and skeet shooting equipment and displaying a major surface circumscribed at the periphery thereof by a perpendicular lip, said hanger comprising:

(i) an upper lobe adapted to interact with said horizontal arm to suspend said hanger downwardly therefrom;

(ii) an elongated shaft having first and second ends, said shaft being attached at said first end thereof to said upper lobe;

(iii) a lower lobe of unitary construction rigidly attached to said second end of said shaft; and (iv) a clasp attached to said lower lobe and adapted to receive and to grip the lip of the clay target at a chosen location therealong with a compressive force directed parallel to said shaft, said clasp comprising:

(A) a clamp plate attached to said second end of said shaft and oriented generally horizontally when said hanger is suspended from said horizontal arm, said clamp plate having an inner end and an outer end;

(B) a gripping jaw having an inner end and an outer end and being disposed opposing said clamp plate with said outer end of said gripping jaw facing said outer end of said clamping plate to define therebetween an entrance into said clasp smaller than the thickness of the lip of the clay target; and (C) a resiliently deformable neck interconnecting said inner end of said clamp plate with said inner end of said gripping jaw.

26. A system as recited in claim 25, wherein said upper lobe of said hanger is configured as an open hook adapted to capture said horizontal arm.

27. A system as recited in claim 25, wherein the transverse width of said shaft of said hanger is small relative to the width of said upper lobe of said hanger measured parallel to said width of said shaft.

28. A system as recited in claim 25, wherein said upper lobe of said hanger, said elongated shaft of said hanger, and said lower lobe of said hanger are integrally formed from a resilient plastic material.

29. A system as recited in claim 25, wherein said upper lobe of said hanger is configured as an open hook adapted to capture said horizontal arm, and the opening to said hook is on the same side of said shaft of said hanger as said entrance to said clasp of said hanger.

30. A system as recited in claim 25, wherein the transverse width of said shaft of said hanger is small relative to the width of said lower lobe of said hanger measured parallel to said width of said shaft.

31. A system as recited in claim 25, wherein said brace comprises:

(a) a sleeve proportioned to slidably encircle said outer surface of said upright, said shoulder of said brace projecting in a perpendicular relationship to said sleeve from the exterior thereof; and (b) said receiving bore enclosed by said shoulder comprises:

(i) an open outer end remote from said sleeve; and (ii) an inner end adjacent to said sleeve, said inner end of said receiving bore opening to the interior of said sleeve, whereby said one end of said horizontal arm is selectively enterable through said receiving bore from said outer end thereof into said interior of said sleeve, thereby with said one end of said horizontal arm to support from the top of said upright said brace and said horizontal arm.

32. A system as recited in claim 25, wherein said base comprises:

(a) an elongated footing having opposed longitudinally extending first and second edges; and (b) parallel first and second stakes projecting from said first edge of said footing, said first and second stakes and said footing defining a plane of said base, and said base thereby having an upper face and a lower face on opposite sides of said plane thereof.

33. A system as recited in claim 32, wherein said alternative capture means of said base comprises:

(a) first capture means on said upper face of said base for receiving the lower end of said upright and maintaining said upright in a perpendicular orientation to said plane of said base when said lower face of said base rests on a hard surface; and (b) second capture means on said second edge of said footing for receiving the lower end of said upright and maintaining said upright in coplanar orientation with said plane of said base when said stakes are driven into soft ground.

34. A system as recited in claim 32, wherein said base further comprises a handle projecting from said second edge of said footing.

35. A system as recited in claim 34, wherein said handle of said base is disposed in said plane of said base.

36. A system as recited in claim 33, wherein said first capture means of said base comprises a noncircular receiving socket on said footing, said receiving socket opening toward said upper face of said base.

37. A system as recited in claim 36, wherein the interior cross-sectional shape of said receiving socket of said first capture means is similar to and larger than the exterior cross-sectional shape of the lower end of said upright.

38. A system as recited in claim 33, wherein said first capture means of said base comprises a mounting post on said upper face of said base.

39. A system as recited in claim 38, wherein the shape of the outer profile of the cross section of said mounting post of said first capture means is noncircular.

40. A system as recited in claim 39, wherein said mounting post of said first capture means is slidably receivable in a recess in the lower end of said upright.

41. A system as recited in claim 33, wherein said second capture means of said base comprises a mounting post projecting from said second edge of said footing in said plane of said base.

42. A system as recited in claim 41, wherein the shape of the outer profile of the cross section of said mounting post of said second capture means is noncircular.

43. A system as recited in claim 42, wherein the outer transverse cross-sectional configuration of said mounting post of said second capture means is an equilateral triangular shape with rounded vertices.

44. A system as recited in claim 42, wherein said mounting post of said second capture means is slidably receivable in a recess in the lower end of said upright.

45. A system as recited in claim 33, wherein said second capture means of said base comprises a noncircular receiving socket on said second edge of said footing.

46. A system as recited in claim 45, wherein the interior cross-sectional shape of said receiving socket of said second capture means is similar to and larger than the exterior cross-sectional of the lower end of said upright.

47. A system as recited in claim 45, wherein said receiving socket of said second capture means projects from said footing in said plane of said base.

48. A system for supporting a target on a hard surface, said system comprising:

(a) an upright having upper and lower ends;

(b) a base capable of stable disposition on the hard surface, said base comprising:

(i) an elongated footing having opposed longitudinally extending first and second edges;

(ii) first and second stabilization feet projecting from said first edge of said footing, said first and second stabilization feet and said footing defining a plane of said base, and said base thereby having an upper face and a lower face on opposite sides of said plane thereof; and (iii) capture means on said upper face of said base for receiving said lower end of said upright and maintaining said upright in a perpendicular orientation to said plane of said base when said lower face of said base rests on the hard surface;

(c) an elongated horizontal arm from which to suspend the target;

(d) a brace slidable on the outer surface of said upright, said brace comprising a tubular shoulder projecting in perpendicular relation to said upright when said brace is slidably disposed thereupon, said shoulder enclosing a horizontal arm receiving bore having a transverse cross section configured to slidably receive one end of said horizontal arm; and (e) a hanger adapted to suspend from said horizontal arm a clay target of the type cast by trap and skeet shooting equipment and displaying a major surface circumscribed at the periphery thereof by a perpendicular lip, said hanger being of unitary molded construction and comprising:

(i) an upper lobe adapted to interact with said horizontal arm to suspend said hanger therefrom;

(ii) an elongated shaft having first and second ends, said shaft being attached at said first end thereof to said upper lobe; and (iii) a lower lobe attached to said second end of said shaft and comprising resilient means for gripping the lip of the clay target at a chosen location along the lip with a compressive force directed parallel to said shaft.

49. A system as recited in claim 48, wherein said capture means comprises a receiving socket upstanding from said footing perpendicular to said plane of said base opening towards said face of said base.

50. A system as recited in claim 48, wherein said capture means comprises a mounting post projecting from said footing on said upper face of said base perpendicular to said plane of said base.

51. A system as recited in claim 48, wherein said upright comprises a tubular structure with a noncircular exterior cross section.

52. A system as recited in claim 48, wherein said first stabilization foot is parallel to said second stabilization foot and equal in length thereto.

53. A system as recited in claim 48, wherein the transverse width of said shaft of said hanger is small relative to the width of said upper lobe of said hanger measured parallel to said width of said shaft.

54. A system as recited in claim 48, wherein the transverse width of said shaft of said hanger is small relative to the width of said lower lobe of said hanger measured parallel to said width of said shaft.

55. A system as recited in claim 48, wherein said upper lobe of said hanger, said elongated shaft of said hanger, and said lower lobe of said hanger are integrally formed from a resilient plastic material.

56. A system as recited in claim 48, wherein said resilient means of said hanger comprises a clasp adapted to receive the lip of the clay target.

57. A system as recited in claim 56, wherein said clasp of said hanger has an entrance smaller than the thickness of the lip at the chosen location along the lip.

58. A system as recited in claim 56, wherein said clasp of said hanger comprises:

(a) a clamp plate attached to said second end of said shaft of said hanger and oriented generally horizontally when said hanger is suspended from said horizontal arm, said clamp plate having an inner end and an outer end;

(b) a gripping jaw having an inner end and an outer end and being disposed opposing said clamp plate with said outer end of said gripping jaw facing said outer end of said clamping plate to define therebetween said entrance into said clasp; and (c) a resiliently deformable neck interconnecting said inner end of said clamp plate with said inner end of said gripping jaw.

* * * * *